United States Patent [19]

Morrison

[11] Patent Number: 4,915,318

[45] Date of Patent: Apr. 10, 1990

[54] ELECTROMAGNETIC DRAG MECHANISMS FOR FERROUS STRIP

[75] Inventor: Bruce R. Morrison, Jamberoo, Australia

[73] Assignee: John Lysaght (Australia) Limited, Sydney, Australia

[21] Appl. No.: 157,213

[22] Filed: Feb. 5, 1988

Related U.S. Application Data

[63] Continuation-in-part of Ser. No. 780,381, filed as PCT AU85/00021 on Feb. 7, 1985, published as WO87/03461 on Aug. 15, 1985, abandoned.

[51] Int. Cl.[4] ..... B65H 23/10; B65H 35/02; H01F 7/20

[52] U.S. Cl. ..... 242/56.2; 226/195; 242/75.2; 242/76; 242/147 M; 335/289; 335/300

[58] Field of Search ..... 242/56.2, 75.2, 76, 242/147 M; 226/93, 94, 195; 335/289, 300

[56] References Cited

U.S. PATENT DOCUMENTS

| | | | |
|---|---|---|---|
| 2,275,093 | 3/1942 | Spangler | 242/75.2 X |
| 2,433,014 | 12/1947 | Rendel | 242/75.2 X |
| 2,731,212 | 1/1956 | Baker | 242/75.2 |
| 2,880,442 | 4/1959 | Shelby | 242/67.3 R X |
| 3,380,686 | 4/1968 | Gaudin | 242/75.2 |
| 3,672,595 | 6/1972 | Jablin et al. | 242/56.2 X |
| 3,685,711 | 8/1972 | Gay | 242/56.2 X |
| 3,863,858 | 2/1975 | Cauffiel et al. | 242/75.2 |
| 4,075,589 | 2/1978 | Braillon | 335/289 X |
| 4,516,736 | 5/1985 | Andersen | 242/56.2 |

OTHER PUBLICATIONS

Ziobro; "Magnetizing Fixture"; Western Electric Digest, No. 40; 10—1975; pp. 27 and 28.

*Primary Examiner*—John Petrakes
*Attorney, Agent, or Firm*—Barnes & Thornburg

[57] ABSTRACT

An electromagnetic drag pad, particularly for providing all the drag force needed where slit ferrous strip is to be coiled at a coiling station, comprises a panel of drag friction material covering pole faces of an electromagnet which magnetically attracts the moving ferrous strip into frictional engagement with the panel of drag friction material thereby establishing a back tension to permit satisfactory formation of a stable coil of each strip at a coiling station; the electromagnet has a core comprising a multiplicity of elongated spaced apart substantially parallel pole elements defining therebetween gaps which accommodate an electric winding which is connected to a power supply (such as a low voltage DC high amperage supply) for energizing the electromagnet, the pole elements having respective pole faces which provide an alternating array of north and south poles. Typically, the pole elements extend transversely to the strip and these are of the order of 100 pole elements arranged in the array which extends of the order of 1 meter along the direction in which the strips move. The new form of electromagnet disclosed may have other applications.

41 Claims, 5 Drawing Sheets

ELECTROMAGNETIC DRAG MECHANISMS FOR FERROUS STRIP

This application is a continuation-in-part of patent application Ser. No. 780,381 filed as PCT AU85/00021 on Feb. 7, 1985, published as WO85/03461 on Aug. 15, 1985, now abandoned.

TECHNICAL FIELD

This invention relates to the treatment of steel or other magnetiseable strip as it is being wound on to a bulk coil thereof. Typically, the invention may be applied to the slitting of a relatively broad strip into two or more narrower strips as part of the finishing operations at a steel mill.

More particularly, the invention relates to devices for maintaining a back tension in the strip as it is wound on to the coil so as to provide a suitably rigid coil.

BACKGROUND ART

Hitherto, one known method of providing tension is to press against opposite sides of the strip by the use of drag pads in the form of wooden blocks or other rigid support structure wrapped in felt, carpet or other replaceable friction material. A disadvantage of this known method is that dirt particles accumulate on the pads and these sometimes cause scratch marks in the finished strip. In addition, the pressure of the friction pads is often sufficiently high to cause marking or buffing of the strip surface. The foregoing are particularly serious disadvantages because of the modern trend to provide material direct from the mill having a high quality ornamental finish.

Further disadvantages of this known method are that maintenance and running costs are high. More specifically, the friction material has to be replaced frequently, cleaning of the friction material takes up to 20% of total operating time, noise levels are extreme when certain materials are processed, and lubricating oil is used in a not wholly successful attempt to alleviate the noise and buffing problems.

Another known method of providing tension uses treaded bridle-rolls but this method also involves contact with both sides of the strip and can result in colour imprinting from one coil to the next.

Further disadvantages of this method are that it has a high capital cost and the time taken to remove, clean and replace the treaded rolls is of the order of an hour and represents up to 20% of total operating time.

Yet another known method uses the linear motor principle to exert a drag force. This method is particularly appropriate for non-ferrous metals, but has been applied to tensioning steel. Some of the disadvantages of this method are that tension depends strongly on strip speed, and, if the line stops, the strip immediately over the drag stand will heat up quickly to a temperature well in excess of 150° C.

Finally, a method disclosed in U.S. Pat. No. 2,433,014 (RENDEL) uses an electromagnet with a drag facing to provide a small leading tension for a drag stand which consists essentially of a bridle roll system. This method has the major disadvantage of not being able to tension each strand separately, and so is completely unsuitable for tensioning slit strips. Further disadvantages are that the rolls touch both sides of the strip, about 3 m of line length would typically be taken up, and cleaning the rolls would be time consuming.

The tensioning methods of the present invention, as described hereinafter, can be advantageously applied for the coiling of strip where no slitting step is involved but embodiments of the invention are especially advantageous where the more demanding requirements of coiling slit strips exists.

For the coiling of metal strip in a commercial plant, it is known that a drag force of about 3 kN/m width of strip is required to back tension the strip. The tension must be sufficient to ensure that the coils, which are normally wound onto a mandrel, do not collapse during subsequent handling after the mandrel has been withdrawn from the bore of the complete coil. Coils are normally handled by inserting a hook or similar device into the bore. If the coil has been formed without sufficient back tension, then the bore can partially collapse by changing shape from the initial desirable cylindrical shape to an elliptical or kidney shape and then, to permit further normal handling of the coil, it must be restored to the desired shape. This is a difficult, time consuming and a costly task. The alternative is the even more costly option of scrapping the coil.

Coil collapse due to inadequate coiling tension is thought to be due to the fact that the wraps of the coil are not tightly bound to each other by frictional forces and, consequentially, the wraps can slip under the action of the inter-wrap forces generated by the weight of the coil, with the result that the coil will have an elliptical bore. It is considered that each wrap has to support itself in isolation from the other wraps, but since normally the strip is too thin to have sufficient stiffness for a wrap of typical diameter to maintain an approximately cylindrical shape, it is necessary to rely on the friction forces generated when the coil is formed to retain the cylindrical shape. Thus, acute problems arise when the coiling tension is insufficient.

However, if the coiling tension is too high, then a different form of coil collapse can occur. If the coiling tension is too high, then the accumulated pressure exerted by the outer wraps will cause the inner wraps to be forced into compression. If the compressive forces are too high, then the inner wraps will not be able to resist the tendency to buckle inwards. Buckling may be initiated at inhomogeneities in the bore, caused by the recoiling mandrel deviating from a perfect cylinder, or initiation may be due to impact forces which occur during coil handling. In either case, the buckle gradually creeps through the wraps of the coil, resulting in a kidney shaped bore.

Coiling tension must be high enough to prevent the first form of collapse, but not so high as to cause the second form.

SUMMARY OF THE INVENTION

In one aspect, the present invention provides an apparatus for slitting and coiling ferrous strip, the apparatus comprising:

(a) means for supplying the ferrous strip, (b) means for slitting the ferrous strip longitudinally, (c) means for coiling the the slit strips separately from one another, (d) a drag means located upstream of the coiling means for applying a drag force to the strips to facilitate the formation of a stable coil at the coiling means as a result of back tension applied to the strips and the improvement comprising:

(e) providing the drag means in the form of an electromagnet extending across a zone through which the strips pass for attracting magnetically the strips, (f) the electromagnet having a core comprising a multiplicity of elongated spaced apart substantially parallel pole elements defining therebetween gaps which accommodate an electric winding for connection to an electric power supply which energises the electromagnet to attract the strips towards the electromagnet, (g) said pole elements having respective pole faces which upon energisation of the electromagnet provide an alternating array of north and south poles, and (h) drag friction material covering said pole faces for contacting the strips on one face only of each strip, whereby the strips are urged into contact with the drag friction material and the drag force is thereby applied sufficiently to permit satisfactory coiling of said strips.

The invention also consists in a similar apparatus for coiling unslit ferrous strip and also extends to corresponding methods of coiling both slit ferrous strip and unslit ferrous strip. Yet a further aspect of the invention consists in a drag mechanism for use in the above-described apparatus and an electromagnet suitable for use in the drag mechanism and possibly also for other purposes having analogous problems which require the generation of adequate magnetic attractive forces.

The present invention solves the problem of providing for suitable forces to be applied to the ferrous strip by the electromagnetic arrangement described. The electromagnet may incorporate further novel and inventive features which are directed to generating the desired level of electromagnetic forces in thin ferrous strip which typically is of the order of 1 mm thick.

Embodiments of the invention can be formed to provide all or some of the following advantageous features as may be required for particular applications.

(A) Where the ferrous strip is slit, perhaps into a large number of separate strips, an embodiment of the invention can provide a single drag pad structure which permits each of the slit strips to be tensioned separately to a uniform stress level, thereby causing each separate coil to have the same level of resistance to collapse.

Essentially, this entails that at least some degree of relative motion be allowed between the slit strands as they pass through the drag pad structure.

During the cold reduction of continuous strip, it is unavoidable that some parts of the strip (the edges, the centre, or the quarter positions) will receive slightly more reduction than others. A higher reduction results in a greater length, and, during the slitting of a parent coil into a number of slit coil, the difference in length will be revealed. In addition, there is a variation in strip thickness measured across the width of the strip, resulting in some of the slit coils having a larger diameter and the slit strands being wound on at a faster rate. Finally, when the front ends of the slit coils are attached to the mandrel, and the drag force is first applied, the initial distribution of tensions, or lengths of strip between the mandrel and the drag stand, are unlikely to be uniform. Any of these effects can lead to a continuing non-uniformity of tensions between the strips, unless the higher tension on the tighter strips causes them to move through the drag stand at higher speeds, until the stresses are substantially equalised.

(B) By virtue of the fact that embodiments of the invention have the drag friction material engaging only one face of the strip, the free face of the strip is not subjected to any contact and therefore is not susceptible to damage. This characteristic is especially important where the ferrous strip is given a surface treatment which is often in a delicate finished state and damage may result in downgrading or scrapping of the coil.

There is a growing trend towards coating steel with organic films and other decorative finishes continuously on production lines designed especially or partly for this purpose. The application of such coatings in this way is far more economical than coating the steel after it has been fabricated into the final product. Material which is processed on slitting lines is following the above trend, so it is increasingly important to avoid buffing, scratching or discolouring the surface of the strip in any way.

(C) The present invention can be readily embodied in arrangements which permit control of the strip tension over a wide range of values, so that the optimum tension for various products can be accommodated.

Different products have different resistances to coil collapse, have different wear effects on drag stand friction material, and give different tensions for the same drag strand settings. In addition, when starting a new coil on the recoil mandrel, the tension must be reduced to a level where the operators can pull the individual slit strips through the drag stand by hand, while still leaving the tension high enough to prevent the sheared ends from slipping back into the looping pit.

(D) Embodiments of the invention can be very compact thereby assisting with minimisation of building costs.

(E) Embodiments of the invention can be implemented with relatively low capital costs, maintenance costs, and running costs.

(F) The drag friction material will inevitably wear and require periodic replacement. Embodiments of the invention permit this material to be replaced very rapidly.

(G) For environmental reasons, relatively low noise level is desirable and this can be achieved with at least preferred embodiments of the invention.

(H) Compared with some prior proposals, the use of the present invention permits the use of lubricating oil for the strip at the drag stand to be obviated, thereby avoiding the expense of oil and disadvantages for subsequent processing steps.

(I) It has been found with use of the present invention that deleterious heating of the strip can be avoided. It is important that upon the application of back tension for coiling purposes that there is no excessive heating in the strip, whether or not the strip is moving or stationary. If friction material is used, then the maximum allowable temperature is about 60 deg. C, which is the temperature at which commonly applied organic coatings soften and become extremely susceptible to damage. If there is no mechanical contact between the tensioning device and the strip, then the maximum allowable temperature is about 150 deg. C, since an organic coating is likely to degrade quickly above this temperature.

(J) Correct coiling is facilitated by the maintenance of substantially constant back tension irrespective of variations in the line speed. The embodiments of the invention can provide this feature. It has been found that embodiments of the invention can effectively control strip tension from zero to the maximum speed available.

Thus, in general, the present invention deals with many problems by utilising a single pad embodying an effective and novel electro-magnet to attract the strip against the pad and in that way provide the necessary pressure between the strip and pad to induce the required frictional resistance to the movement of the strip. No other ancillary mechanism is needed to enhance the coiling force to a level necessary to prevent coil collapse. Thus, in accordance with the invention, the drag pad contacts only one side of the strip which, in practice, is the rough-finished side on which surface imperfections are of little significance.

The invention also in one embodiment consists in a drag pad suitable for use on a slitting line which slits steel strip in the thickness range of about 0.2 mm to about 1.2 mm, the drag pad comprising an electro-magnet providing an array of closely spaced, parallel, elongate pole faces each of opposite polarity to its neighbouring pole face or faces and a layer of friction material covering said array, each of the elongate pole faces being of tooth-like form with a shoulder adjacent to the pole face extending towards the next adjacent tooth thereby providing a tooth tip overhang with a wider slot between adjacent teeth provided from the tooth tip overhang to the base of each slot, the pitch of the pole faces being between about 5.0 mm and about 12.0 mm, the slot width being between about 2 mm and about 8 mm, the slot depth being between about 15.0 mm and about 40.0 mm, the tooth width being between about 1.5 mm and about 6.0 mm, the tooth tip separation being between about 0.8 mm and about 2.0 mm, and the tooth tip overhang width being between about 0.5 mm and 2.0 mm.

BRIEF DESCRIPTION OF THE TABLE AND DRAWINGS

By way of example, an embodiment of the above described invention is given in more detail hereinafter with reference to the accompanying table and drawings, wherein.

DESCRIPTION OF ILLUSTRATED EMBODIMENTS

Figure 1:
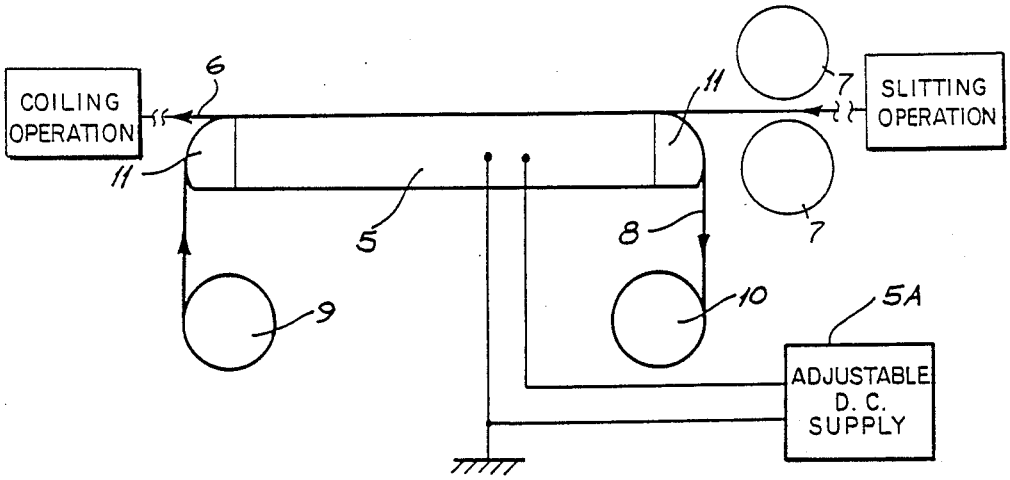
FIG. 1 is a diagrammatic side elevation of a drag pad according to the invention, shown as in use.

The illustrated drag pad, as shown in FIG. 1, comprises an electro-magnet 5 disposed beneath a steel strip or strips 6 issuing from pinch rolls 7 and being drawn therefrom to a wind-up coiler (not shown).

At least the operative part of the surface of the magnet 5 in contact with the strip or strips is covered with a layer 8 (shown in FIG. 1) of cloth friction material. In the illustrated embodiment, the layer 8 is directly interposed between the magnet 5 and the ferrous strip 6 and is part of a long web of cloth wound initially on an uncoiler roll 9 (seen only in FIG. 1) and advanced from time to time as the in-use portion becomes worn to a coiler roll 10.

For preference, the magnet 5 has smoothly curved upstream and downstream nosings 11 providing substantially tangential meeting and departure between the strip 6 and the layer 8.

The magnet 5 is connected to an adjustable d.c. supply 5A whereby the current is variable and the amount of back tension can be controlled to a desirable value. Thus the apparatus can be readily adjusted for use with strips of different thickness.

Figure 2:
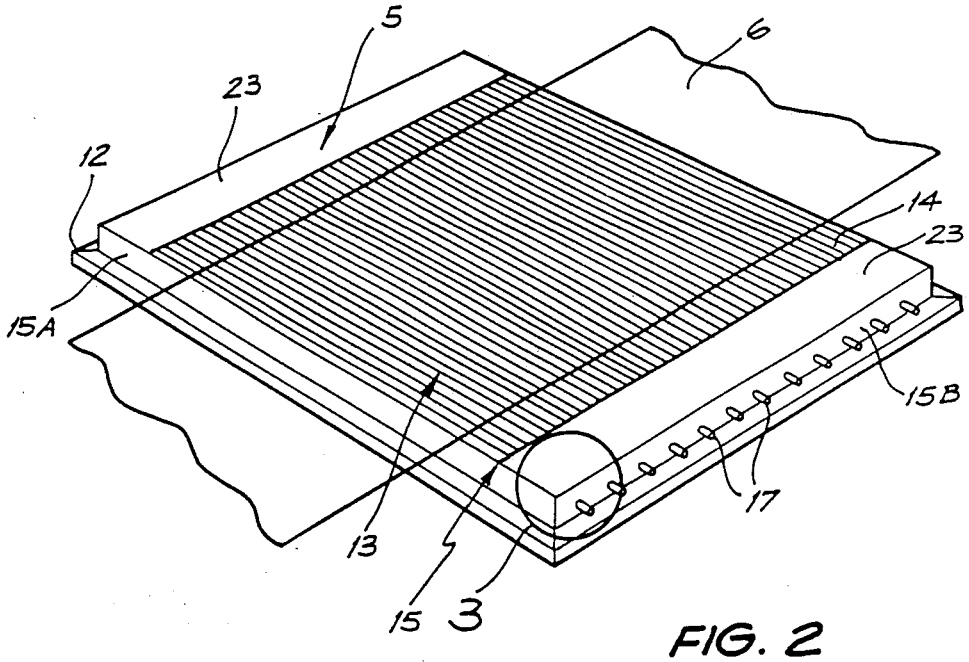
FIG. 2 is a diagrammatic perspective view of the drag pad of FIG. 1 with its layer of friction material omitted.

As shown in FIG. 2, the magnet 5 comprises a base plate 12, an outer angle-iron frame 15 secured to the base plate 12, and a bed 13 of electrical steel laminations 14 stacked face to face within the outer frame. The angle-iron frame 15 comprises a pair of end frame members 15A and a pair of side frame members 15B, both pairs being secured to the base plate 12 by bolts not shown in the drawing. The side frame members 15B are clamped to the steel laminations 14 and to each other by through bolts 16 whereby a solid bed is formed.

Figure 3:
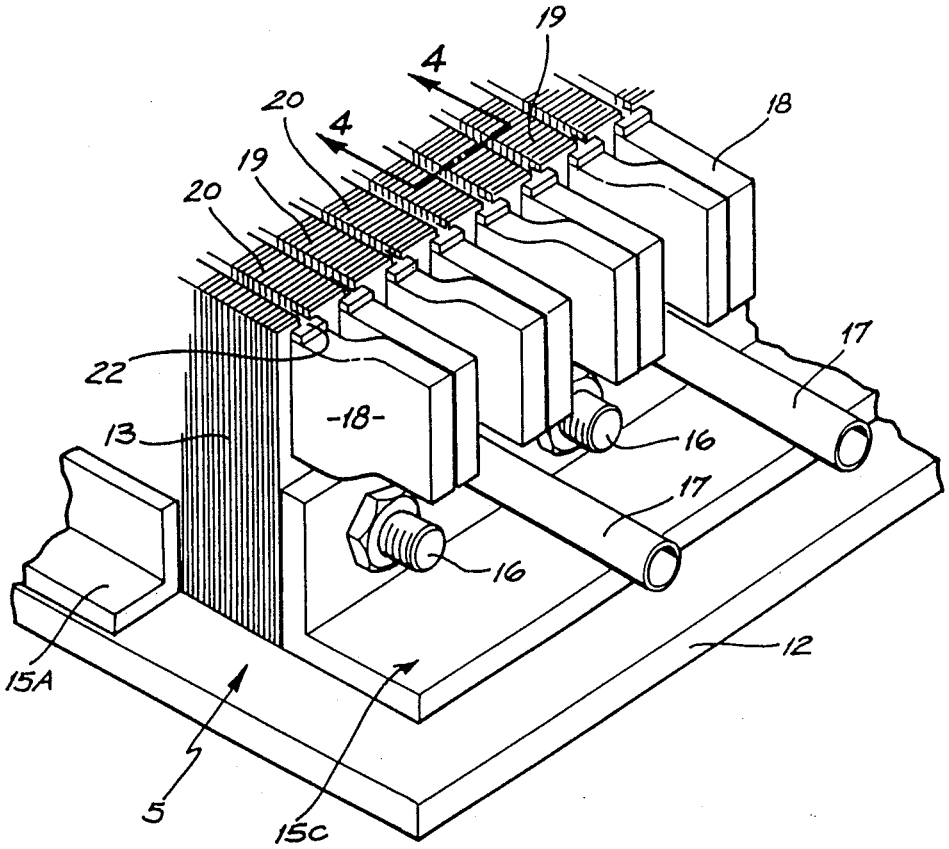
FIG. 3 is a perspective detail view of the internal components within the enclosure marked 3 in FIG. 2, drawn to a larger scale.

FIG. 3 shows the internal construction on an enlarged scale with the outer side frame 15B removed, and before application of an epoxy filler which coats the parts and fills the space between the side of the laminations 14 and the outer side frame; FIG. 3 shows an inner side frame member 15C and a corresponding side frame member is provided on the opposite side. Both these inner side members lie inside the corresponding outer side members 15B, and both have apertures through which cooling tubes 17 pass, the cooling tubes passing through corresponding apertures in the laminations 14 so that cooling water can circulate through the tubes 17 to carry off heat generated by what is necessarily a compact but powerful electro-magnet.

Figure 4:
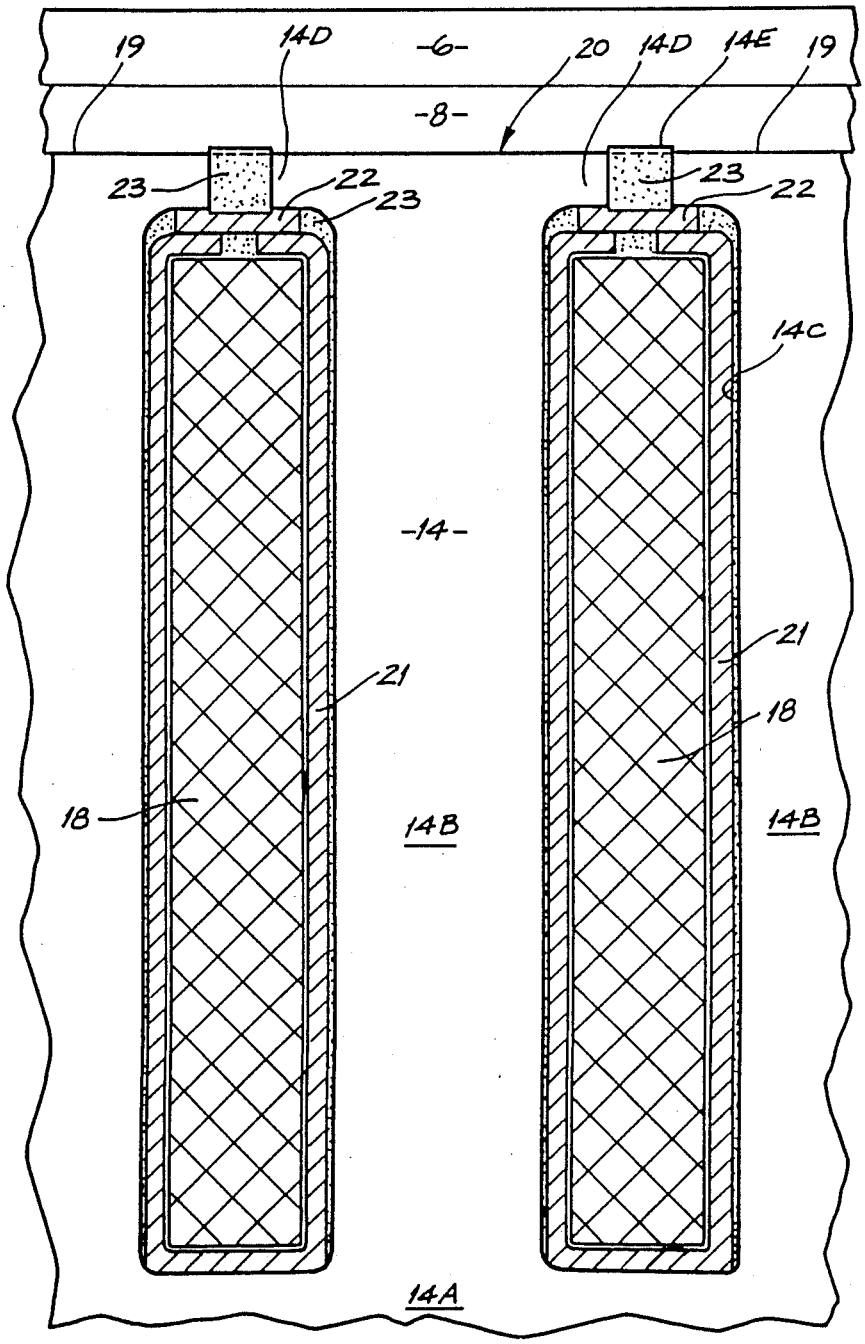
FIG. 4 is a detail sectional view taken on line 4–4 of FIG. 3 drawn to a still larger scale.

As most clearly shown in FIG. 4, each lamination has a base portion 14A and a series of tooth portions 14B with a rectangular slot 14C located between adjacent tooth portions for accommodating the electric winding. Each tooth portion 14 is of T-shape, except for the outer-most tooth portion which has only one laterally extending arm known as a tooth tip 14D. Thus a relatively narrow gap 14E is provided between adjacent tooth tips.

The illustrated embodiment is a single turn electric winding formed from a set of solid copper strap conductors 18 which are each wrapped with a layer of insulation material 21, except for the end portions of the strap conductors where they project out of the bed 13 and are electrically interconnected by brazing or soldering whereby the series of strap conductors forms a serpentine single winding; the pole elements respectively are defined by a stack of tooth portions 14B having upper faces providing pole faces. As shown in the drawing, the pole faces are an alternating array of north and south pole faces 19 and 20 respectively.

As shown in FIG. 4, the strap conductors 18 are secured in the respective rectangular slots 14C by wedges 22. After assembly of the electromagnet, the entire combination of the bed of laminations and the windings are thoroughly coated in an insulating, hard setting synthetic resin which fills the gaps as shown by resin 23 in FIG. 4. This resin also fills the sidespaces up to the side frame members 15B.

As an alternative to the friction material in the form of the layer 8 shown in FIG. 1, the operative layer of friction material may be part of a larger sheet wrapped about the magnet 5 in the same way as such sheets are conventionally wrapped about the wooden body of a conventional drag pad. Furthermore, the friction material may be bonded to a very thin layer of steel and either wound on in the manner previously described and shown in FIG. 1, or simply placed on the magnet surface as a sheet, and held in position by magnetic forces, each sheet being replaced when worn.

As shown in the drawings it is preferred for the drag pad to be disposed in use so that the magnet pole faces extend transversely of the strip being processed, although other orientations are known to be effective. The length of each pole face is preferably at least equal to the width of the strip.

A typical embodiment which produces a particularly compact and powerful electromagnet is one having of the order of a hundred pole faces typically for extending transversely to a ferrous strip (which will often be of the order of 1 meter wide) and the electromagnet will extend of the order of 1 meter or more in the direction of travel of the strip. Typical dimensions for the electromagnet are as follows:

Pitch of the pole faces 5.0 mm to 12.0 mm
Slot width 2.0 mm to 8.0 mm
Slot depth 15.0 mm to 40.0 mm
Tooth width 1.5 mm to 6.0 mm
Tooth tip separation 0.8 mm to 2.0 mm
Tooth tip overhang width 0.5 mm to 2.0 mm In the interest of electrical safety, in the preferred embodiment the magnet is energised by a low voltage power supply, e.g. of the order of 50 volts. The use of the single rectangular section copper strap has been chosen so that the copper packing fraction in the slot may be as high as possible, thereby minimising the power dissipation for a given magnetic field strength.

Because the polarity of the magnetic pole faces alternates from one to the next and as the pole faces are quite close together, there is very little net magnetic field at even quite short distances from the drag pad as a whole. Indeed, to ensure that a substantial proportion of the magnetic field extends within the strip being processed, it is preferable for the friction material to be somewhat thinner than is conventional, preferably less than 1.0 mm, thickness. Additionally it has been found that the necessary forces cannot be readily achieved without having a magnet at least 0.5 m. long.

If desired, to further reduce damage to the unfinished side of the strip which contacts the drag pad, the area of contact may be extended by comparison with that of conventional pads and a lesser pressure may be used.

In order to maximise the attractive force between the magnet and the strip it is necessary to maximise the magnetic flux between the magnet and the strip. A finite element model of the magnet has been used to design laminations of somewhat different shapes, each design giving the maximum possible flux density between the magnet and the strip and therefore having the theoretical maximum possible specific attractive force for a particular set of conditions. The eight sets of conditions and the corresponding designs, together with their predicted performances, are summarised in Table 1.

Figure 5:
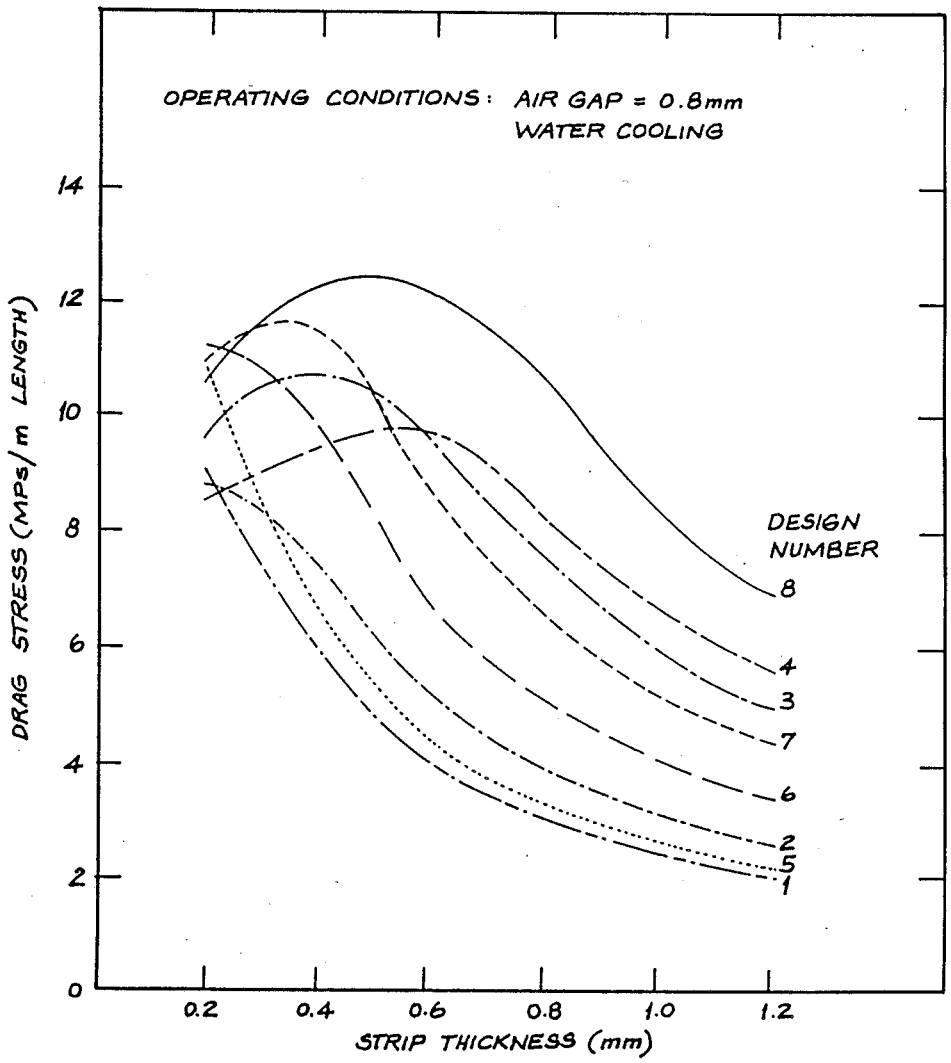
FIG. 5 is a graph showing the theoretical specific force generated by several different magnet designs, each design being optimised for somewhat different conditions.

FIG. 5 shows the theoretical specific drag stress generated in steel strip by each design as a function of strip thickness, for the set of operating conditions which correspond most closely to the average expected operating conditions on slitting lines in a major part of the sheet and coil industry. It can be seen that the design No. 8 gives perhaps the best compromise performance over the whole range of strip thicknesses.

Figure 6:
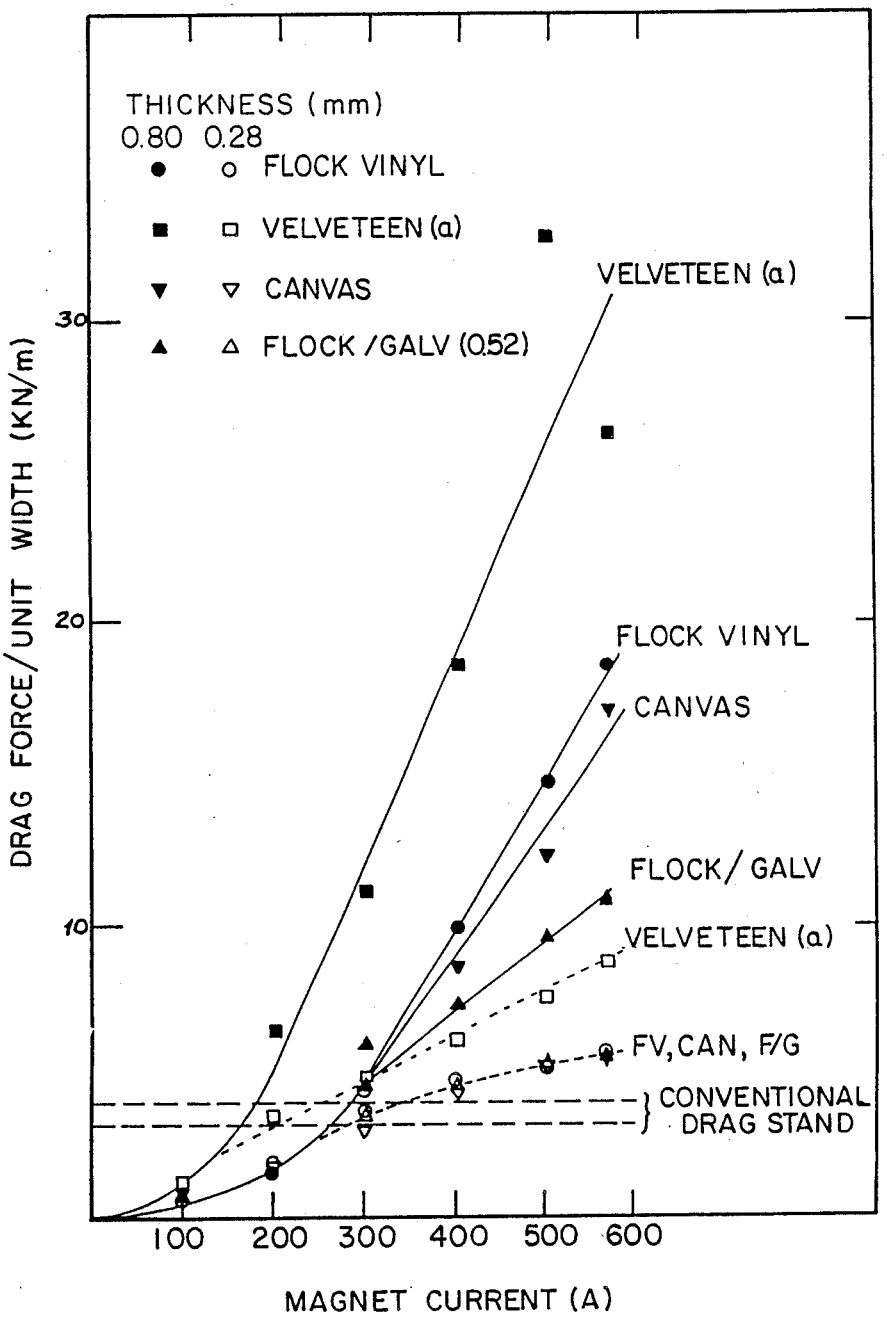
FIG. 6 is a graph showing the measured tensioning force generated by a drag magnet constructed to one of the above designs, compared with the tensioning force generated by a conventional friction pad drag stand; and Table 1 summarises the design conditions and the resulting lamination designs the performance of which are given in FIG. 5.

FIG. 6 shows the experimental drag force generated by a magnet based on design No. 8. Various types of friction material were used, as indicated, together with two strip thicknesses representative of the range of interest. Also shown on this graph is the range of drag forces generated by a conventional drag stand under normal operating conditions. Under all circumstances the magnetic drag stand is capable of generating forces at least as high as the range generated by the conventional drag stand.

As an aid to further understanding of the manner in which embodiments of the invention operates, further explanation of what is believed to be relevant but much simplified scientific theory will be given, but the applicant does not guarantee the completeness or correctness of the theory and this explanation is not to be taken as binding or definitive of the invention in any way.

If the ferrous strip is relatively thick compared with half the tooth width, i.e. half the pole face width, and/or if the current in the illustrated electromagnet is of relatively low value (say less than 50 amps) then, where:

$f_s$ is the magnetic flux in the ferrous strip and
$f_l$ is the magnetic flux permeating the air space above the ferrous strip and
$F_a$ is the magnetic attractive force at right angles to the pole faces, then Since $f_l$ is negligible $$F_a \propto f_s^2$$

It has been found that $f_s$ is almost linearly related to current and thus the initial portion of the curves for embodiments of the invention shown in FIG. 6 have a square law dependence.

However, if the ferrous strip is relatively thin and/or the current relatively high, as occurs with embodiments of the invention when in use, then $f_l$ is a significant quantity and then $$F_a \propto (f_s+f_l)^2-(f_l)^2 \propto f_s^2+2f_lf_s$$

Thus a linear relationship occurs as is shown in FIG. 6. It is to be noted that $f_s^2$ is in practice a constant if the strip is magnetically saturated, which occurs where the strip thickness is sufficiently thin and/or the current reasonably high. The factor $f_l$ is responsible for any increase and this is linearly dependant upon current.

Furthermore, it is to be noted that some flux extends between the top portions of the pole elements and also across between the pole faces. When current is increased beyond a certain value, this flux becomes significant, there is saturation of the tooth portions and a plateau is then reached on the force/current curve, although this plateau has not been shown in FIG. 6.

TABLE 1

Summary of conditions under which eight magnet laminations have been optimised, the parameters describing the optimised laminations, and the theoretical performance under these design conditions. In each case the maximum allowed temperature of the surface of the magnet is 60 deg. C., the tooth tip overhang width is 1.0 mm, and the assumed coefficient of friction between the steel web and the friction material is 0.2.

| | Design Number | | | | | | | |
|---|---|---|---|---|---|---|---|---|
| | 1 | 2 | 3 | 4 | 5 | 6 | 7 | 8 |
| | Operating Conditions | | | | | | | |
| Cooling method | Air | | | | Water | | | |
| Strip Thickness (mm) | 0.2 | 0.2 | 0.45 | 0.45 | 0.2 | 0.2 | 0.45 | 0.45 |
| Pad Thickness (mm) | 0.6 | 0.8 | 0.6 | 0.8 | 0.6 | 0.8 | 0.6 | 0.8 |
| | Lamination Design | | | | | | | |
| Slot Width (mm) | 3.8 | 4.6 | 4.8 | 6.4 | 3.0 | 3.4 | 3.6 | 4.2 |
| Slot Depth (mm) | 30 | 35 | 32 | 34 | 20 | 25 | 20 | 24 |
| Tooth Width (mm) | 2.7 | 2.9 | 4.0 | 3.8 | 2.8 | 3.4 | 3.8 | 4.6 |
| Tooth Tip Separation (mm) | 1.14 | 1.4 | 1.2 | 1.5 | 1.2 | 1.6 | 1.2 | 1.6 |
| | Performance Under Design Conditons | | | | | | | |
| Specific Drag Force (kN/m length/m width) | 1.9 | 1.4 | 4.7 | 3.5 | 2.7 | 2.2 | 6.8 | 5.5 |
| Specific Drag Stress (MPa/m length) | 9.6 | 7.3 | 10.5 | 7.8 | 13.9 | 11.2 | 15.1 | 12.4 |

Note:
Specific forces and stresses are related to a magnet of unit length and unit width.

I claim:

1. Apparatus for slitting and coiling ferrous strip, the apparatus comprising:

(a) means for supplying the ferrous strip;

(b) means for slitting the ferrous strip longitudinally, (c) means for coiling the slit strips separately from one another, (d) a drag means located upstream of the coiling means for applying a drag force to the strips to facilitate the formation of a stable coil at the coiling means as a result of back tension applied to the strips and the improvement comprising:

(e) said drag means being substantially solely in the form of an electromagnet extending across a zone through which the strips pass for attracting magnetically the strips with sufficient force to permit coiling of the strips at the coiling means, (f) the electromagnetic having an electric winding, an electric power supply, a core extending at least about 500 mm along the direction in which the strips move, the core comprising at least about 50 elongated, spaced-apart, substantially parallel pole elements defining therebetween gaps which accommodate said electric winding for connection to said electric power supply which energizes the electromagnetic to attract the strips towards the electromagnet, (g) said pole elements having respective pole faces which upon energization of the electromagnet provide an alternating array of north and south poles, and (h) drag friction material covering said pole faces for contacting the strips on one face only of each strip, whereby the strips are urged into contact with the drag friction material and the drag force is thereby applied sufficiently to permit satisfactory coiling of said strips.

2. Apparatus as claimed in claim 1, wherein the pole faces extend in a common plane.

3. Apparatus as claimed in claim 1, wherein the pole faces each extend transversely across all said strips.

4. Apparatus as claimed in claim 1, wherein of the order of 100 pole elements are provided.

5. Apparatus as claimed in claim 1, wherein the electromagnet extends of the order of 1 meter along the direction in which said strips move.

6. Apparatus as claimed in claim 1, wherein said electric winding is arranged in a serpentine form passing sequentially back and forth through said adjacent gaps.

7. Apparatus as claimed in claim 6, wherein said electric winding is formed from copper strips one of which passes through each of said gaps and is electrically insulated from the adjacent faces of the pole elements which define each said gap, and said copper strips being electrically interconnected to the next adjacent strip at the respective ends of the pole elements to provide said serpentine form.

8. Apparatus as claimed in claim 1, wherein said core comprises a base portion from which said pole elements extend in tooth-like form, the core being formed from a multiplicity of laminations clamped together.

9. Apparatus as claimed in claim 8, wherein the pole elements have a pitch in the range of about 5 mm to 12 mm, each of said gaps has a width in the range of about 2 mm to 8 mm, each of said pole elements having substantially the same height from said base and in the range of about 15 mm to about 40 mm and the width of each pole element is in the range of about 1.5 mm to 6 mm.

10. Apparatus as claimed in claim 9 and wherein each of the pole elements is of generally T-shaped cross sectional shape with the head of the T-shape providing said pole face and each arm of the T-shape projecting in the range of about 0.5 mm to about 2 mm, adjacent arms of adjacent pole elements being separated by an amount in the range of about 0.8 mm to about 2 mm and said electric winding being accommodated in the portions of the gap between the arms of the T-shape and the base of the core.

11. Apparatus as claimed in claim 1 and further comprising a direct current electric supply for energising the electromagnet and connected to the ends of said electric winding, the electric supply being adapted to provide a current in the range of about 300 amps to 500 amps and at a voltage of about 30 volts to 50 volts during the coiling process.

12. Apparatus as claimed in claim 1, wherein said drag friction material comprises a textile fabric and said electromagnet co-operates therewith to provide a drag force of at least 3 kN/m width to said strips.

13. Apparatus as claimed in claim 12, and further comprising a supply coiler for mounting a roll of the textile fabric and for advancing the textile fabric over the electromagnet, and a receiving coiler located to roll up the textile fabric when advanced over the electromagnet, means being provided to advance intermittently unused fabric from the supply coiler to be positioned over the pole faces and for the used fabric to be taken up by the receiving coiler, and tensioning means being provided for tensioning the fabric between the coilers.

14. Apparatus as claimed in claim 12 and further comprising a metal substrate located over said pole faces and wherein said drag friction material comprises a textile fabric secured to said metal substrate.

15. Apparatus for slitting and coiling a ferrous web of about 1 mm thickness, the apparatus comprising:

(a) means for supplying the ferrous web;

(b) means for slitting the ferrous web longitudinally into strips, (c) means for coiling the strips, (d) drag means located upstream of the coiling means for applying a drag force to the web to permit the formation of a stable coil at the coiling means as a result of back tension applied to the web and wherein the improvement comprises:

(e) said drag means comprising an electromagnet and a drag friction material covering the electromagnet, the electromagnet providing substantially all of the required drag force of at least 3 kN/m width when the ferrous web is of the order of 1 mm thick whereby sufficient drag force is applied to provide satisfactory coiling of the strips at the mandrel, (f) the electromagnet having an electric winding, an electric power supply, a core extending at least about 500 mm along the direction in which the strips move, the core comprising at least about 50 elongated, spaced-apart, substantially parallel pole elements defining therebetween gaps which accommodate said electric winding for connection to said electric power supply which energizes the electromagnet to attract the strips towards the electromagnet and into frictional engagement with the drag friction material whereby the drag force is generated, and (g) said pole elements having respective pole faces which upon energization of the electromagnet provide an alternating array of north and south poles.

16. Apparatus as claimed in claim 15, wherein the pole faces extend in a common plane.

17. Apparatus as claimed in claim 15, wherein the pole faces each extend transversely across all said strips.

18. Apparatus as claimed in claim 15, wherein of the order 100 pole elements are provided.

19. Apparatus as claimed in claim 15, wherein the electromagnet extends of the order of 1 meter along the direction in which said strips move.

20. Apparatus as claimed in claim 15, wherein said electric winding is arranged in a serpentine form passing sequentially back and forth through said adjacent gaps.

21. Apparatus as claimed in claim 20, wherein said electric winding is formed from copper strips one of which passes through each of said gaps and is electrically insulated from the adjacent faces of the pole elements which define each said gap, and said copper strips being electrically interconnected to the next adjacent strip at the respective ends of the pole elements to provide said serpentine form.

22. Apparatus as claimed in claim 15, wherein said core comprises a base portion from which said pole elements extend in tooth-like form, the core being formed from a multiplicity of laminations clamped together.

23. Apparatus as claimed in claim 22, wherein the pole elements have a pitch in the range of about 5 mm to 12 mm, each of said gaps has a width in the range of about 2 mm to 8 mm, each of said pole elements having substantially the same height from said base and in the range of about 15 mm to about 40 mm and the width of each pole element is in the range of about 1.5 mm to 6 mm.

24. Apparatus as claimed in claim 23 and wherein each of the pole elements is of generally T-shaped cross sectional shape with the head of the T-shape providing said pole face and each arm of the T-shape projecting in the range of about 0.5 mm to about 2 mm, adjacent arms of adjacent pole elements being separated by an amount in the range of about 0.8 mm to about 2 mm and said electric winding being-accommodated in the portions of the gap between the arms of the T-shape and the base of the core.

25. Apparatus as claimed in claim 15 and further comprising a direct current electric supply of energising the electromagnet and connected to the ends of said electric winding, the electric supply being adapted to provide a current in the range of about 300 amps to 500 amps and at a voltage of about 30 volts to 50 volts during the coiling process.

26. Apparatus as claimed in claim 15, wherein said drag friction material comprises a textile fabric and said electromagnet co-operates therewith to provide a drag force of at least 3 kN/m width to said strips.

27. Apparatus as claimed in claim 26, and further comprising a supply coiler for mounting a roll of the textile fabric for advancing the textile fabric over the electromagnet, and a receiving coiler located to roll up the textile fabric when advanced over the electromagnet, means being provided to advance intermittently unused fabric from the supply coiler to be positioned over the pole faces and for the used fabric to be taken up by the receiving coiler, and tensioning means being provided for tensioning the fabric between the coilers.

28. Apparatus as claimed in claim 26 and further comprising a metal substrate located over said pole faces and wherein said drag friction material comprises a textile fabric secured to said metal substrate.

29. A drag mechanism adapted for use in an apparatus for slitting and coiling thin ferrous strip and having means for supplying ferrous strip, means for slitting ferrous strip longitudinally and means for coiling the slit strips separately from one another, the drag mechanism being adapted to be located upstream of said coiling means for applying a drag force to the strips to facilitate the formation of a stable coil at the coiling means as a result of back tension applied to the strips, the drag mechanism including a panel of drag friction material over which said strips are arranged to pass in frictional, back tension producing engagement and means for applying force for urging said strips into engagement with the drag friction material, and the improvement comprising said force means comprising an electromagnet over which said panel of drag friction material is located, the electromagnet providing substantially all of the force required for said drag force to be generated, and the electromagnet having an electric winding, and electric power supply, a core extending at least about 500 mm along the direction in which the strips move, the core comprising at least about 50 elongated, spaced-apart, substantially parallel pole elements defining therebetween gaps which accommodate said electric winding for connection to said electric power supply which energizes the electromagnet to attract the strips towards the electromagnet, said pole elements having respective pole faces which upon energization of the electromagnet provide an alternating array of north and south poles.

30. A drag mechanism as claimed in claim 29, wherein the pole faces extend in a common plane.

31. A drag mechanism as claimed in claim 30, wherein said drag friction material comprises a textile fabric and said electromagnet corporates therewith to provide a drag force of at least 3 kN/m width to said strips.

32. A drag mechanism as claimed in claim 29, wherein the pole faces each extend transversely across all said strips.

33. A drag mechanism as claimed in claim 29, wherein of the order 100 pole elements are provided.

34. A drag mechanism as claimed in claim 29, wherein the electromagnet extends of the order of 1 meter along the direction in which said strips move.

35. A drag mechanism as claimed in claim 29, wherein said electric winding is arranged in a serpentine form passing sequentially back and forth through said adjacent gaps.

36. A drag mechanism as claimed in claim 29 wherein said core comprises a base portion from which said pole elements extend in tooth-like form, the core being formed from a multiplicity of laminations clamped together.

37. A drag mechanism as claimed in claim 29 and further comprising a direct current electric supply for energising the electromagnet and connected to the ends of said electric winding, the electric supply being adapted to provide way in use a current in the range of about 300 amps to 500 amps and at a voltage of about 30 volts to 50 volts.

38. An electromagnet adapted for use in a drag mechanism of an apparatus for slitting said coiling a thin ferrous web into strips, the drag mechanism being adapted to be located upstream of coiling means of the apparatus for applying a drag force to the slit ferrous strips whereby the strips can be wound into a stable coil at the coiling means as a result of back tension applied to the strips, the drag mechanism comprising a panel of drag friction material supported over the electromagnet for engaging frictionally with the strips and applying the back tension and force application means for urging the strips into frictional engagement with the panel of drag friction material whereby the drag force is provided for an electromagnet, said electromagnet being adapted to operate as said force application means and the electromagnet comprising a core of the order of 1 m long and 1 m wide and having of the order of 100 elongated, spaced-apart, substantially parallel pole elements which extend across the electromagnet, the pole elements defining therebetween gaps, a single turn, low voltage electric winding accommodated in said gaps and extending sequentially therethrough, a low voltage power supply, said low voltage electric winding being connected to said low voltage electric winding being connected to electromagnet to attract the ferrous strips towards the electromagnet, said pole elements having respective pole faces which upon energization of the magnet provide an alternating array of north and south poles.

39. An electromagnet for attracting thereto thin ferrous strip material, the electromagnet comprising a core extending at least about 500 mm along the electromagnet, the electromagnet including a base and at least about 50 elongated, spaced-apart, substantially parallel pole elements of strip-like form each projecting from the base and defining therebetween gaps, the free end faces of said pole elements providing pole faces, and a single low-voltage, high-current electric winding being disposed in a serpentine manner in said gaps and passing back and forth across the electromagnet in said gaps in sequence along the electromagnet, and a low-voltage, high-current power supply, the electric winding having means for connection to said low-voltage, high-current power supply for energizing the electromagnet, each of said pole elements being T-shaped in cross section taken at right angles to the direction of elongation of said pole elements, the gap between adjacent pole elements being relatively narrow between the horizontal legs of adjacent T-shaped pole elements at the pole faces and for a major portion of the height of the gap taken perpendicular to said pole faces, the gap being wider between the vertical legs of adjacent T-shaped pole elements and said electric winding is accommodated in said wider portion of said gap.

40. An electromagnet as claimed in 39 and wherein said core comprises a multiplicity of substantially identical laminations, clamped together and having cooling passages extending therethrough in said base portion.

41. A method of coiling thin ferrous strip comprising advancing ferrous strip along a work path from a supply, slitting the ferrous strip into a multiplicity of strips, applying a drag force to the strips to apply back tension and coiling the strips at a coiler, the drag force being applied substantially solely through a panel of drag friction material contacting one side of the strips and applying a drag force of at least 3 kN/m width to tension the strips, and the improvement comprising using an electromagnet at the face of the panel of drag friction material remote from the strips to attract the strips into frictional engagement with the panel of drag friction material, thereby providing substantially all of the drag force supplied to one face only of the strip, the electromagnet extending across the width of said strips and having an electric winding, an electric power supply, a core extending at least about 500 mm along the direction in which the strips move, the core comprising at least about 50 elongated, spaced-apart, substantially parallel pole elements defining therebetween gaps which accommodate said electric winding connected to said electric power supply which energizes the electromagnet to attract the strips towards the electromagnet, said pole elements having respective pole faces which upon energization of the electromagnet provide an alternating array of north and south poles.

* * * * *

UNITED STATES PATENT AND TRADEMARK OFFICE

CERTIFICATE OF CORRECTION

PATENT NO. : 4,915,318

DATED : April 10, 1990

INVENTOR(S) : Morrison

It is certified that error appears in the above-identified patent and that said Letters Patent is hereby corrected as shown below:

In column 9, line 45, replace "electromagnetic" with --electro-magnet--.

In column 13, line 50, replace "said" with --and--.

In column 14, line 4, after "voltage", delete "electric winding being connected to electromagnet" and insert therefor --power supply which energizes the electromagnet--.

Signed and Sealed this

Seventeenth Day of September, 1991

*Attest:*

HARRY F. MANBECK, JR.

*Attesting Officer*

*Commissioner of Patents and Trademarks*